US008365532B2

(12) United States Patent
Zuo et al.

(10) Patent No.: US 8,365,532 B2
(45) Date of Patent: Feb. 5, 2013

(54) APPARATUS AND METHOD FOR A GAS TURBINE NOZZLE

(75) Inventors: Baifang Zuo, Simpsonville, SC (US); Willy Steve Ziminsky, Greenville, SC (US); Thomas Edward Johnson, Greer, SC (US); John Charles Intile, Simpsonville, SC (US); Benjamin Paul Lacy, Greer, SC (US)

(73) Assignee: General Electric Company, Schenectady, NY (US)

( * ) Notice: Subject to any disclaimer, the term of this patent is extended or adjusted under 35 U.S.C. 154(b) by 434 days.

(21) Appl. No.: 12/570,678

(22) Filed: Sep. 30, 2009

(65) Prior Publication Data

US 2011/0072824 A1 Mar. 31, 2011

(51) Int. Cl.
*F02C 1/00* (2006.01)

(52) U.S. Cl. ..... 60/737

(58) Field of Classification Search ..... 60/737, 60/739, 740, 742, 746–748; 239/399, 402, 239/405, 461, 463; 431/187, 284, 285, 287
See application file for complete search history.

(56) References Cited

U.S. PATENT DOCUMENTS

| | | | | |
|---|---|---|---|---|
| 5,020,329 | A * | 6/1991 | Ekstedt et al. | 60/737 |
| 5,251,447 | A * | 10/1993 | Joshi et al. | 60/737 |
| 6,354,072 | B1 * | 3/2002 | Hura | 60/776 |
| 6,453,660 | B1 * | 9/2002 | Johnson et al. | 60/39.821 |
| 6,484,489 | B1 * | 11/2002 | Foust et al. | 60/776 |
| 6,993,916 | B2 | 2/2006 | Johnson et al. | |
| 7,003,958 | B2 | 2/2006 | Dinu et al. | |
| 7,171,813 | B2 * | 2/2007 | Tanaka et al. | 60/737 |
| 7,878,000 | B2 * | 2/2011 | Mancini et al. | 60/740 |
| 2004/0050057 | A1 * | 3/2004 | Bland et al. | 60/737 |
| 2008/0302105 | A1 * | 12/2008 | Oda et al. | 60/737 |
| 2009/0050710 | A1 | 2/2009 | Myers et al. | |
| 2009/0111063 | A1 | 4/2009 | Boardman et al. | |
| 2009/0139236 | A1 | 6/2009 | Yilmaz et al. | |

* cited by examiner

*Primary Examiner* — Phutthiwat Wongwian
(74) *Attorney, Agent, or Firm* — Dority & Manning, P.A.

(57) ABSTRACT

A nozzle includes an inlet, an outlet, and an axial centerline. A shroud surrounding the axial centerline extends from the inlet to the outlet and defines a circumference. The circumference proximate the inlet is greater than the circumference at a first point downstream of the inlet, and the circumference at the first point downstream of the inlet is less than the circumference at a second point downstream of the first point. A method for supplying a fuel through a nozzle directs a first airflow along a first path and a second airflow along a second path separate from the first path. The method further includes injecting the fuel into at least one of the first path or the second path and accelerating at least one of the first airflow or the second airflow.

18 Claims, 4 Drawing Sheets

APPARATUS AND METHOD FOR A GAS TURBINE NOZZLE

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves an apparatus and method for supplying fuel to a gas turbine. Specifically, the present invention includes a contoured nozzle that may be used in a combustor in a gas turbine.

BACKGROUND OF THE INVENTION

Gas turbines are widely used in commercial operations for power generation. Operating that gas turbine at higher temperatures generally increases the thermodynamic efficiency of the gas turbine. However, higher operating temperatures often produce localized hot spots in the combustors near the nozzle exits if fuel and air are not well mixed prior to combustion. Localized hot spots may increase the chance for flame flash back and flame holding. Flame flash back and flame holding may occur with any fuel and are especially associated with high reactive fuels, such as hydrogen fuel, which has a much higher burning rate and much wider flammability range than fuels having a lower reactivity. Flame flash back and flame holding should be avoided during operations as the nozzles may be burnt at such events. In addition, uneven fuel/air mixing with the localized hot spot increases the generation of NOx, and uneven fuel/air mixing with the localized cold spots increases the emission of carbon monoxide and unburned hydrocarbons, all of which are undesirable exhaust emissions.

A variety of techniques exist to allow higher operating temperatures while minimizing localized hot spots and undesirable emissions. For example, various nozzles have been developed to more uniformly mix the fuel with the working fluid prior to combustion. A more uniform fuel mixture allows the gas turbine to operate on a near fully premixed combustion that produces fewer hot spots and generates lower emissions. Flame holding and flame flash back happen when the flame burning velocity is higher than the local flow velocity. To prevent flame holding or flash back, flow velocity needs to be increased which often requires an additional pressure drop across the nozzles, and the pressure drop across the nozzles detracts from the overall thermodynamic efficiency of the gas turbine.

Therefore, the continued need exists for an improved nozzle that can support increasingly higher combustion temperatures and high reactive fuels while minimizing localized hot spots, flame holding, and the pressure drop across the nozzle.

BRIEF DESCRIPTION OF THE INVENTION

Aspects and advantages of the invention are set forth below in the following description, or may be obvious from the description, or may be learned through practice of the invention.

One embodiment of the present invention is a nozzle that includes an axial centerline and a center body disposed about the axial centerline. The center body includes a leading edge and a trailing edge downstream of the leading edge. A shroud surrounds the center body and defines a circumference. The nozzle further includes a plurality of vanes between the center body and the shroud, and the circumference of the shroud proximate the leading edge of the center body is greater than the circumference of the shroud proximate the trailing edge of the center body.

In another embodiment of the present invention, a nozzle includes an inlet, an outlet downstream of the inlet, and an axial centerline between the inlet and the outlet. The nozzle further includes a shroud surrounding the axial centerline, extending from the inlet to the outlet, and defining a circumference. The circumference of the shroud proximate the inlet is greater than the circumference of the shroud at a first point downstream of the inlet, and the circumference of the shroud at the first point downstream of the inlet is less than the circumference of the shroud at a second point downstream of the first point.

A further embodiment of the present invention includes a method for supplying a fuel through a nozzle. The method includes directing a first airflow along a first path through an axial centerline of the nozzle, directing a second airflow along a second path across a plurality of vanes, and separating the first path from the second path. The method further includes injecting the fuel into at least one of the first path or the second path, and accelerating at least one of the first airflow or the second airflow.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
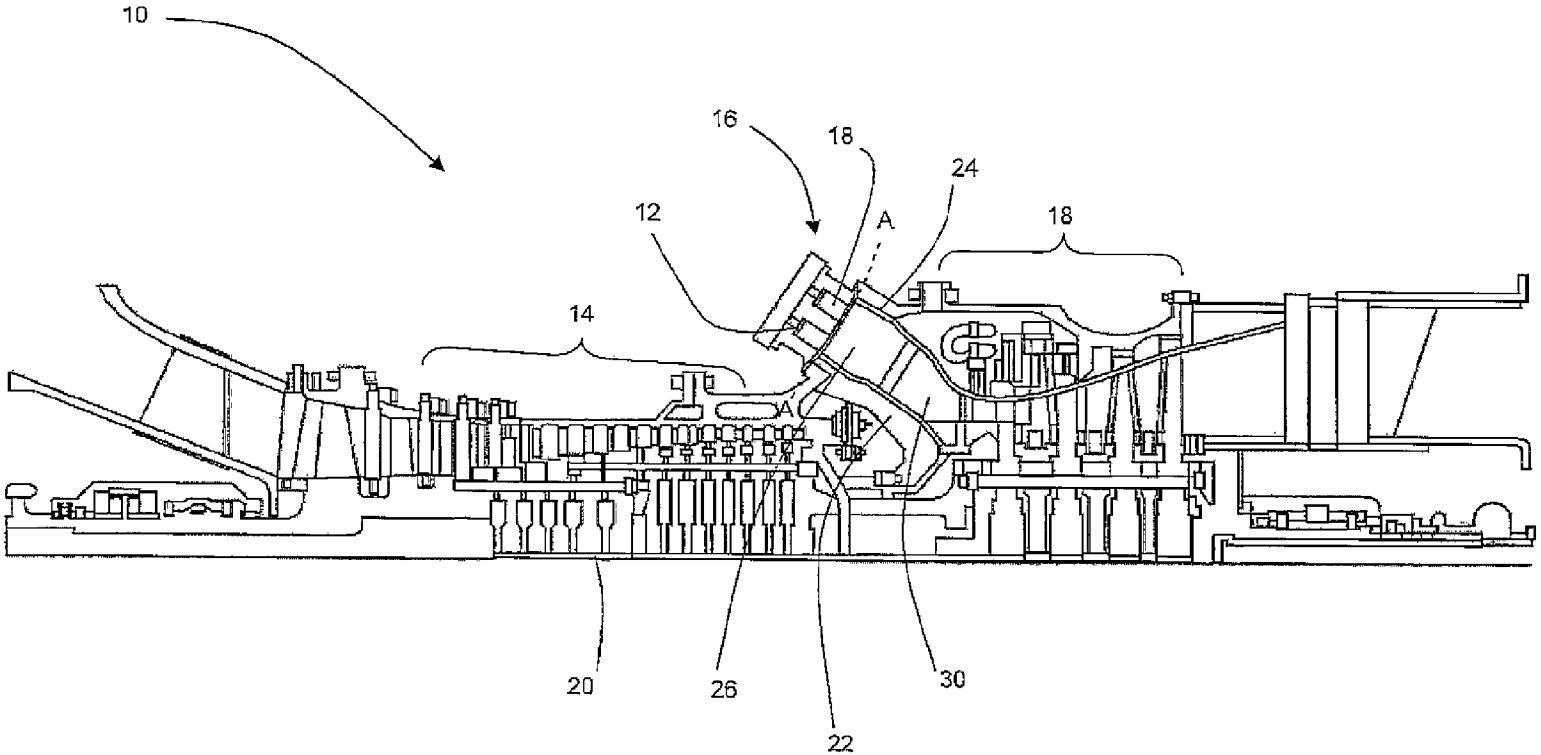
FIG. 1 is a simplified cross-section of a gas turbine having nozzles within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 shows a gas turbine 10 having nozzles 12 within the scope of the present invention. The gas turbine 10 generally includes a compressor 14 at the front, one or more combustors 16 around the middle, and a turbine 18 at the rear. The compressor 14 and the turbine 18 may share a common rotor 20.

The compressor 14 imparts kinetic energy to a working fluid (air) by compressing it to bring it to a highly energized state. The compressed working fluid exits the compressor 14 and flows through a compressor discharge plenum 22 to the combustor 16. A liner 24 surrounds each combustor 16 and defines a combustion chamber 26. The nozzles 12 mix fuel with the compressed working fluid in a downstream mixing zone 28. Possible fuels include blast furnace gas, coke oven gas, natural gas, vaporized liquefied natural gas (LNG), hydrogen, and propane. The mixture of fuel and working fluid flows to the combustion chamber 26 where it ignites to generate combustion gases having a high temperature and pressure. The combustion gases flow through a transition piece 30 to the turbine 18 where they expand to produce work.

Figure 2:
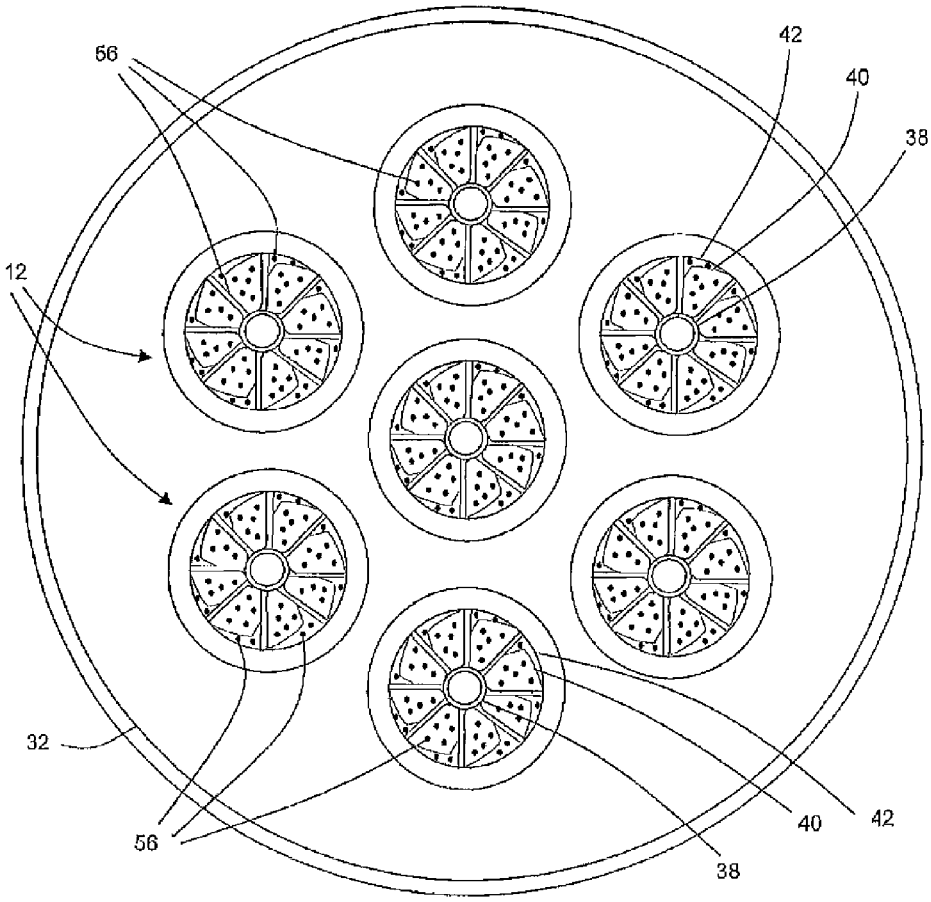
FIG. 2 is a simplified plan diagram of the nozzles shown in FIG. 1 taken along line A-A.
Figure 3:
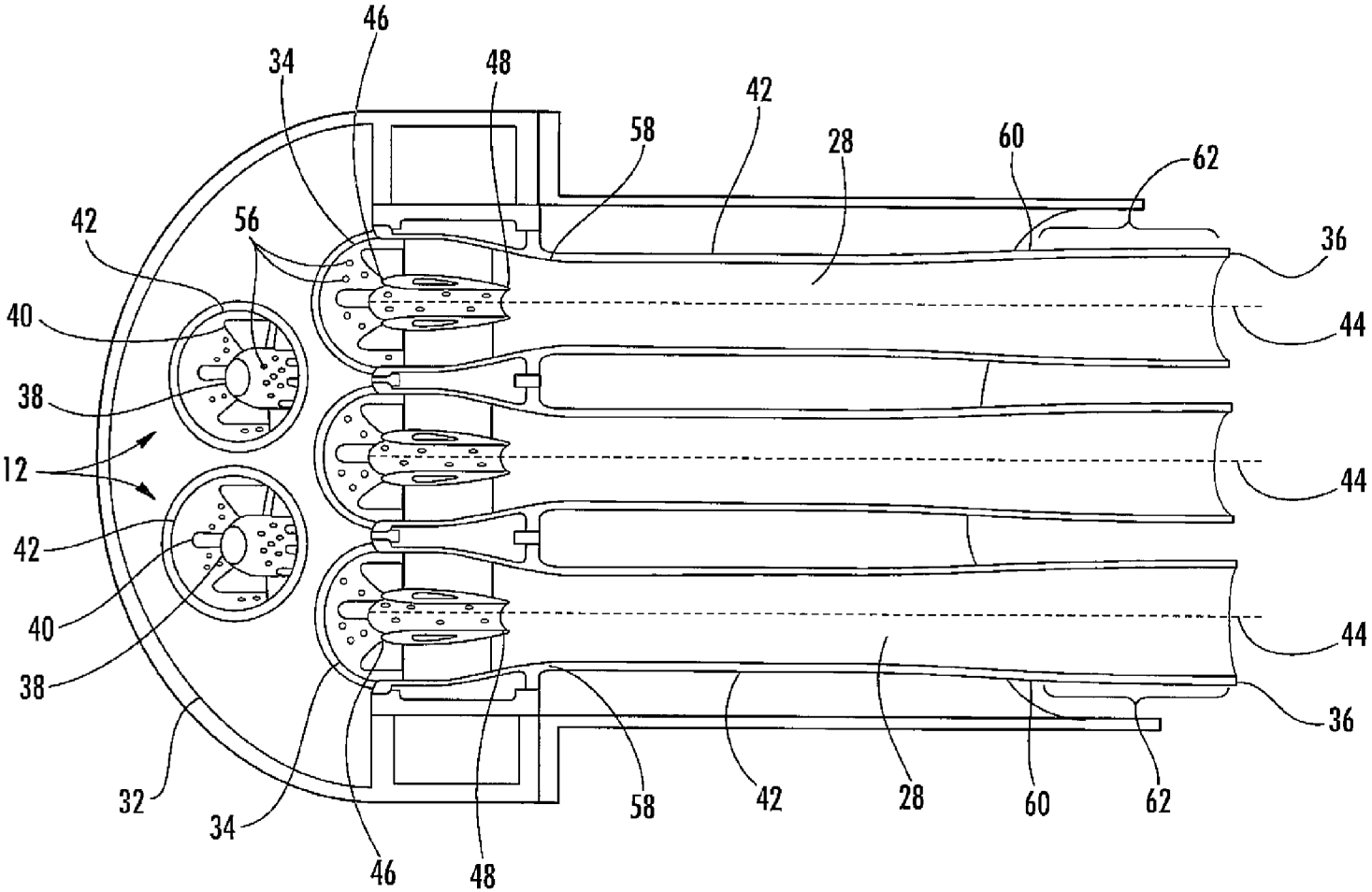
FIG. 3 is a simplified perspective cross-section of the nozzles shown in FIG. 1.

FIG. 2 shows a simplified plan diagram of the nozzles 12 shown in FIG. 1 taken along line A-A, and FIG. 3 shows a simplified perspective cross-section of the nozzles 12 shown in FIG. 1. As shown in FIGS. 2 and 3, a top cap 32 provides structural support for the nozzles 12. The nozzles 12 are arranged in the top cap 32 in various geometries, such as the six nozzles 12 surrounding a single nozzle 12, as shown in FIG. 2. Additional geometries include seven nozzles surrounding a single nozzle or any suitable arrangement according to particular design needs. Each nozzle 12 includes an inlet 34 and an outlet 36 downstream (i.e., in the direction of airflow) of the inlet 34. Each nozzle 12 may further include a center body 38, a plurality of swirler vanes 40, and/or a shroud 42.

The center body 38 is generally circular in shape and disposed about an axial centerline 44 of the nozzle 12, although the particular shape and concentricity of the center body 38 are not requirements of each embodiment within the scope of the present invention. The center body 38 includes a leading edge 46 proximate the inlet 34 of the nozzle 12 and a trailing edge 48 downstream (i.e., in the direction of airflow) of the leading edge 46. The leading edge 46 may be rounded to minimize any disruption of the airflow passing on either side of the center body 38. The trailing edge 48 may end at a point to minimize any recirculation of the fuel and air mixture passing by the center body 38. The combination of the leading edge 46 and trailing edge 48 may therefore define an airfoil shape cross-section for the center body 38.

The swirler vanes 40 extend between the center body 38 and the shroud 42. Each nozzle 12 generally includes three to twelve swirler vanes 40, although the scope of the present invention includes any number of swirler vanes 40, depending on the particular design needs.

Figure 4:
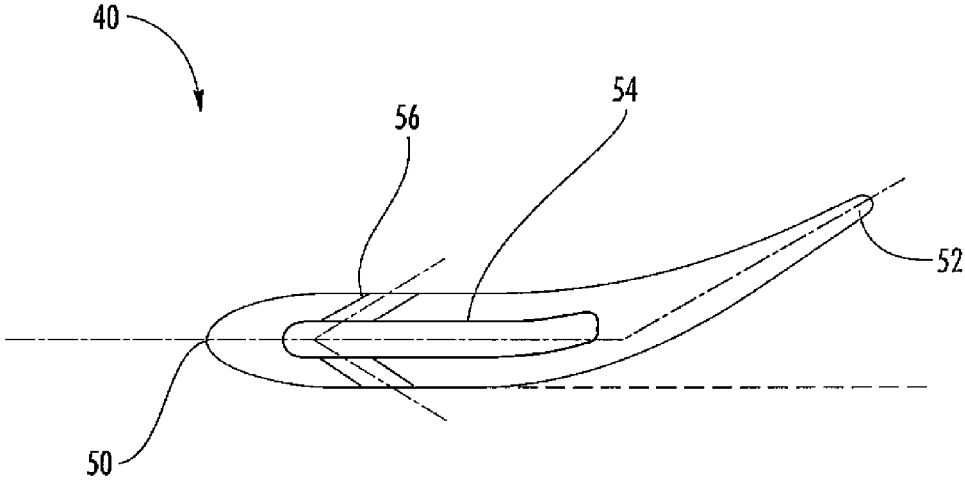
FIG. 4 is a cross-section of an embodiment of a swirler vane within the scope of the present invention.

FIG. 4 shows a cross-section of an embodiment of a swirler vane 40 within the scope of the present invention. As with the center body 38, each swirler vane 40 includes a leading edge 50 proximate the inlet 34 of the nozzle 12 and a trailing edge 52 downstream (i.e., in the direction of airflow) of the leading edge 50. The leading edge 50 may be rounded and include a fillet where the leading edge connects to the center body 38 and shroud 42 to minimize any disruption of the airflow passing on either side of the swirler vane 40. The trailing edge 52 may end at a point to minimize any recirculation of the fuel and air mixture passing across the swirler vane 40. The combination of the leading edge 50 and trailing edge 52 may therefore define an airfoil shape for the swirler vanes 40.

As shown in FIG. 4, the swirler vanes 40 may further include an internal passage 54 or cavity that provides fluid communication for the flow of fuel through the shroud 42, the swirler vanes 40, and the center body 38. Fuel ports 56 on either side of the center body 38, either side of the swirler vanes 40, and/or inside of the shroud 42 may be used to inject fuel into the airflow. The diameter of the fuel ports 56 may be between approximately 0.010 inches and 0.080 inches, and the fuel ports 56 may be angled approximately 25 degrees to 90 degrees with respect to the axial centerline 44. The diameter and angle of the fuel ports 56 combine to ensure that the fuel adequately penetrates into the airstream and to prevent the fuel from simply streaming along the center body 38, the swirler vanes 40, and/or the shroud 42. The diameter and angle of the fuel ports 56 also combine to ensure that local flame holding possibility is minimized.

The swirler vanes 40 may be aligned with the axial centerline 44 to stabilize the airflow entering the downstream mixing zone 28. In alternate embodiments, the trailing edge 52 of the swirler vanes 40 may be angled as much as approximately 60 degrees with respect to the axial centerline 44 to impart a swirling motion on the airflow passing over the swirler vanes 40. The swirling motion imparted by the swirling vanes 40 creates a shear force between the swirling airflow exiting the swirling vanes 40 and the non-swirling airflow exiting the center body 38. This shear force facilitates improved mixing between the fuel and the compressed working fluid in the downstream mixing zone 28, potentially allowing for a shorter nozzle 12 that reduces pressure loss, material, and manufacturing costs. Flame holding and flash back margins will also be improved.

The shroud 42 surrounds the center body 38 and axial centerline 44, extends from the inlet 34 to the outlet 36, and defines a circumference. As the compressed working fluid enters the nozzle 12, the center body 38 directs a first airflow along a first path through the interior of the center body 38 and along the axial centerline 44. The shroud 40 and the center body 38 combine to direct a second airflow along a second path, separate from the first path, between the shroud 40 and the center body 38 and across the swirler vanes 40. The first airflow combines with the second airflow downstream of the trailing edge 48 of the center body 38 and the injected fuel to create a mixture flow. The mixture flow proceeds to the downstream mixing zone 28 where the fuel and compressed working fluid continue mixing before exiting the outlet 36 and entering the combustion chamber 26.

The circumference of the shroud 42 gradually changes from the inlet 34 to the outlet 36, first decreasing and then increasing, giving the shroud 40 a contour that resembles a venturi. In particular embodiments, the circumference at the inlet 34 and the circumference at the outlet 36 may be sized to produce approximately equal cross-sectional areas at the inlet 34 and outlet 36 to minimize the pressure drop across the nozzle 12 and to maximize the flow area.

The circumference of the shroud 42 begins decreasing in the vicinity of the inlet 34 or leading edge 46 of the center body 38 and continues decreasing until reaching a first point 58 downstream of the inlet 34. The precise location of the first point 58 may vary slightly according to the design needs of particular embodiments, but it is generally proximate or slightly downstream of the trailing edge 48 of the center body 38. The circumference proximate the inlet 34 or leading edge 46 of the center body 38 is thus greater than the circumference proximate the trailing edge 48 of the center body 38.

The decrease in the circumference between the inlet 34 and the first point 58 coincides with the tapering shape of the swirling vanes 40 and the center body 38. This decrease in the circumference decreases the cross-sectional area for the first and/or second airflow, causing a corresponding acceleration or increase in velocity of the first and/or second airflow. It is anticipated that the decrease in circumference from the inlet 34 to the first point 58 may increase the airflow velocity two to three time in some embodiments, thus reducing the chance that flame holding may occur in the vicinity of the fuel ports 56 and downstream from the fuel ports 56 to the first point 58.

The circumference of the shroud 42 begins increasing downstream of the first point 58 until it reaches a second point 60. The precise location of the second point 60 may be at any place along the shroud 42 between the first point 58 and the outlet 36, with the actual location dependent on the design needs of particular embodiments. The circumference at the second point 60 is thus greater than the circumference at the first point 58.

The increase in the circumference between the first point 58 and the second point 60 generally coincides with the location of the downstream mixing zone 28. This increase in the circumference increases the cross-sectional area for the mixture flow, causing a corresponding deceleration or decrease in velocity of the mixture flow. Correspondingly, flow pressure loss is recovered.

In the embodiment illustrated in FIG. 3, the circumference of the shroud 42 remains constant from the second point 60 to the outlet 36. As a result, the shroud 42 defines a cylinder 62 from the second point 60 to the outlet 34. This constant circumference stabilizes the velocity and pressure of the fuel and compressed working fluid mixture as it exits the nozzle 12 and enters the combustion chamber 26 to reduce the chance that flame flash back may occur inside the nozzle 12.

It should be appreciated by those skilled in the art that modifications and variations can be made to the embodiments of the invention set forth herein without departing from the scope and spirit of the invention as set forth in the appended claims and their equivalents.

What is claimed is:

1. A nozzle, comprising:
a. an axial centerline;
b. a center body disposed about the axial centerline, wherein the center body includes a leading edge, a trailing edge downstream of the leading edge, and an air flow path completely through the center body from the leading edge to the trailing edge along the axial centerline;
c. a shroud surrounding the center body and defining a circumference and a downstream end;
d. a plurality of vanes between the center body and the shroud;
e. wherein the circumference of the shroud proximate the leading edge of the center body is greater than the circumference of the shroud proximate the trailing edge of the center body and the circumference of the shroud increases at a point downstream of the trailing edge of the center body; and
f. a combustion chamber downstream from the downstream end of the shroud.

2. The nozzle of claim 1, wherein the shroud defines a cylinder downstream of the trailing edge of the center body.

3. The nozzle of claim 1, wherein the leading edge and the trailing edge of the center body define an airfoil shape cross-section.

4. The nozzle of claim 1, wherein at least some of the plurality of vanes are angled approximately 0 degrees to 60 degrees with respect to the axial centerline.

5. The nozzle of claim 1, further including a plurality of fuel ports in at least one of the center body, the shroud, or the plurality of vanes.

6. The nozzle of claim 5, wherein at least some of the plurality of fuel ports are angled approximately 25 degrees to 90 degrees with respect to the axial centerline.

7. The nozzle of claim 1, wherein at least some of the plurality of vanes extend continuously between the center body and the shroud.

8. The nozzle of claim 1, wherein the shroud extends continuously along an axial length of the center body.

9. The nozzle of claim 1, wherein the shroud defines a cylinder at the downstream end.

10. The nozzle of claim 1, wherein the center body includes at least one fuel port on an outer surface of the center body.

11. A nozzle, comprising:
a. an inlet;
b. an outlet downstream of the inlet;
c. an axial centerline between the inlet and the outlet;
d. a center body disposed about the axial centerline, wherein the center body defines an air flow path completely through the center body along the axial centerline and includes at least one fuel port on an outer surface of the center body;
e. a shroud surrounding the axial centerline, extending from the inlet to the outlet, and defining a circumference;
f. wherein the circumference of the shroud proximate the inlet is greater than the circumference of the shroud at a first point downstream of the inlet;
g. wherein the circumference of the shroud at the first point downstream of the inlet is less than the circumference of the shroud at a second point downstream of the first point; and
h. a combustion chamber downstream from the outlet.

12. The nozzle of claim 11, wherein the center body has a leading edge and a trailing edge downstream of the leading edge and the leading edge and the trailing edge of the center body define an airfoil shape cross-section.

13. The nozzle of claim 12, further including a plurality of vanes between the center body and the shroud.

14. The nozzle of claim 13, wherein at least some of the plurality of vanes are angled approximately 0 degrees to 60 degrees with respect to the axial centerline.

15. The nozzle of claim 13, further including a plurality of fuel ports in at least one of the center body, the shroud, and the plurality of vanes.

16. The nozzle of claim 13, wherein at least some of the plurality of vanes extend continuously between the center body and the shroud.

17. The nozzle of claim 11, wherein the shroud extends continuously from the inlet to the outlet.

18. The nozzle of claim 9, wherein the shroud defines a cylinder at the outlet.

* * * * *